US006790018B2

(12) United States Patent
Lee et al.

(10) Patent No.: US 6,790,018 B2
(45) Date of Patent: Sep. 14, 2004

(54) RECIPROCATING COMPRESSOR HAVING AN EXHAUST VALVE CONTROLLED BY AN ELECTROMAGNET

(75) Inventors: In Won Lee, Gwangmyeong-si (KR); Kwang Hyup An, Seoul (KR); Jeong-Ho Lee, Gyeonggi-do (KR); In Seop Lee, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 10/194,259

(22) Filed: Jul. 15, 2002

(65) Prior Publication Data

US 2003/0124008 A1 Jul. 3, 2003

(30) Foreign Application Priority Data

Jan. 3, 2002 (KR) ..... 2002-207

(51) Int. Cl.[7] ..... F04B 39/08; F04B 7/00

(52) U.S. Cl. ..... 417/505; 417/280; 251/65; 251/129.15

(58) Field of Search ..... 417/505, 280, 417/297, 415; 251/65, 129.15

(56) References Cited

U.S. PATENT DOCUMENTS 4,690,371 A * 9/1987 Bosley et al. ..... 251/65
4,705,070 A * 11/1987 Eidsmore ..... 137/614.21
4,795,317 A * 1/1989 Cusack ..... 417/322
5,265,843 A * 11/1993 Kleinhappl ..... 251/129.17
5,893,390 A * 4/1999 Beam, III ..... 137/599.11
6,380,832 B2 * 4/2002 Oyama et al. ..... 335/281

* cited by examiner

*Primary Examiner*—Justine R. Yu
*Assistant Examiner*—William H. Rodriguez
(74) *Attorney, Agent, or Firm*—Greenblum & Bernstein, P.L.C.

(57) ABSTRACT

Disclosed is an exhaust valve capable of correctly opening/shutting an exhaust port of a cylinder based upon variation of the flux density of an electromagnet. The inventive exhaust valve may comprise a guide connected in parallel to an exhaust port of a cylinder, a needle valve provided inside the guide for opening/shutting the exhaust port while moving in cooperation with the guide. The needle valve may be controlled with an electromagnet. The invention enables complete opening of the exhaust port of the cylinder in exhaustion thereby preventing degradation of compression efficiency due to valve damage while reducing generation of vibration and noise.

21 Claims, 7 Drawing Sheets

RECIPROCATING COMPRESSOR HAVING AN EXHAUST VALVE CONTROLLED BY AN ELECTROMAGNET

BACKGROUND OF THE INVENTION

1. Field of the Invention

The present invention relates to an exhaust valve, in particular, capable of correctly opening an outlet port of a cylinder while maximizing compression efficiency.

2. Description of the Related Art

Generally in a cooling cycle, fluid having a large amount of heat is sucked and then exhausted after loosing heat through compressing, condensing, expanding and evaporating processes.

A cooling apparatus for performing the above processes may comprise a compressor, a condenser, expansion valves and an evaporator. The compressor sucks and compresses coolant evaporated in the evaporator to raise the pressure thereof so that coolant may be converted into a state liquefiable at a relatively high temperature.

In general, the compressor is divided into a reciprocating compressor, a revolving compressor, a scrolling compressor and the like according to application policies thereof. The reciprocating compressor can compress coolant through processes of sucking, compressing and exhausting coolant gas as a piston reciprocates inside a cylinder. The reciprocating compressor has a suction valve for sucking coolant, a cylinder for compressing coolant introduced through the suction valve and an exhaust valve for exhausting coolant compressed in the cylinder.

FIG. 1 is a schematic perspective view illustrating a conventional reciprocating compressor.

Referring to FIG. 1, the reciprocating compressor comprises a column-shaped cylinder 11, a piston 12 for being inserted into one side of the cylinder 11 and performing a linear reciprocating motion inside the cylinder 11 to compress fluid, suction and exhaust valves 14 and 15 arranged in opposition to the front of the piston 12 for sucking and exhausting fluid, a valve plate 13 arranged between the suction valve 14 and the exhaust valve 15 for supporting the suction and exhaust valves 14 and 15 and a head cover 16 having channels for fluid which is introduced into the cylinder 11 and exhausted from the same.

The reciprocating compressor further comprises a connecting rod 17 connected to the rear of the piston 12 and a crank shaft 18 connected to the rod 17 and rotated by a motor (not shown).

Briefly describing the operation of the reciprocating compressor, the motor (not shown) is driven to rotate the crank shaft 18 so that the connecting rod 17 connected to the crank shaft 18 may move in a circle in cooperation with the connecting rod 17. The movement of the connecting rod 17 causes the piston 12 connected thereto to perform a linear reciprocating motion so that fluid is sucked into the cylinder 11, compressed therein, and then exhausted therefrom.

In the above operation, the suction and exhaust valves 14 and 15 perform sucking and exhausting procedures as follows and have the following structures.

FIGS. 2A to 2D are schematic plan views illustrating a head cover (FIG. 2A), an exhaust valve (FIG. 2B), a valve plate (FIG. 2C) and a suction valve (FIG. 2D), respectively, in a conventional reciprocating compressor. Seen from the front of the piston in FIG. 1, the cylinder may be sequentially coupled with the inlet valve, the valve plate, the outlet valve and the head cover in the order of description, i.e. from the inlet valve to the head cover.

Referring to FIGS. 2A to 2D, the valve plate 13 includes a suction port 13*a* for sucking fluid and an exhaust port 13*b* for exhausting fluid as a member for supporting the suction valve 14 and the exhaust valve 15.

The suction valve 14 is a member arranged between the valve plate 13 and the cylinder 11, and has a suction plate 14*a* at a position corresponding to the suction port 13*a* of the valve plate 13 and an exhaust port 14*b* at a position corresponding to the exhaust port 13*b* of the valve plate 13.

Further, the exhaust valve 15 is a member arranged between the valve plate 13 and the head cover 16, and has an exhaust plate 15*a* at a position corresponding to the exhaust port 13*b* of the valve plate 13 and a suction port 15*b* at a position corresponding to the suction port 13*a* of the valve plate 13.

The head cover 16 is a member for defining the channels of fluid sucked and exhausted into/from the cylinder, and has a suction tube 16*a* at a position corresponding to the suction port 13*a* of the valve plate and an exhaust tube 16*b* at a position corresponding to the exhaust port 13*b*.

Description will be made about the operation of the conventional reciprocating compressor including the suction valve 14, the valve plate and the exhaust valve 15 having the above configuration. When the piston 12 moves backward inside the cylinder 11 due to the circular motion of the crank shaft, the pressure within the cylinder 11 is lowered to fold the suction plate of the suction valve. Therefore, fluid is sucked into the cylinder via the folded suction plate 14*a* after passing through the suction tube 16*a*, the suction port 15*b* and the suction port 13*a* of the valve plate.

Fluid sucked as above is compressed as the piston 12 moves forward due to the circular motion of the crank shaft. Fluid compressed like this passes through the exhaust port 14*b* of the suction valve and the exhaust port 13*b* of the valve plate, and then flows out via the exhaust tube 16*b* of the head cover pushing out the exhaust plate 15*a* of the exhaust valve which is supported by a spring and the like.

FIGS. 3A and 3B schematically illustrate the operation of the exhaust valve in the conventional reciprocating compressor, in which the suction valve is not shown for the convenience's sake of description.

Describing a process of exhausting fluid from the cylinder in reference to FIGS. 3A and 3B, fluid compressed via forward movement of the piston is exhausted via the exhaust port 13*b* of the valve plate, i.e. out of the cylinder pushing out the exhaust plate 15*a* of the exhaust valve. Preferably, the exhaust plate of the exhaust valve is made of a material capable of resisting a certain amount of pressure.

After fluid is exhausted, the piston moves backward due to the circular motion of the crank shaft accordingly lowering the pressure within the cylinder so that the exhaust pate 15*a* is shut due to its own elasticity to prevent further exhaustion of fluid.

The above process continuously takes place as the crank shaft continuously performs the circular motion while the piston connected thereto repeatedly performs the reciprocating motion.

However, according to the operation of the exhaust valve in the above reciprocating compressor, it can be seen that the exhaust plate 15*a* of the exhaust valve is folded for a certain degree instead of being completely folded in an exhausting process. Since the exhaust plate 15*a* is not completely folded as above, fluid is obstructed in exhaustion along a proceeding direction thereby preventing smooth exhaustion.

Further, the above valve is opened according to the fluid pressure inside the cylinder so that the exhaust valve is opened later than a desired time point thereby resulting in overshooting as a problem.

Further, when the exhaust valve 15*a* is shut in a sucking process, the entire portion of the exhausting valve 15*a* contacting to the valve plate 13 hits the valve plate 13 to produce noise. Heavy noise also takes place from vibration of the valve and fluid leakage through a gap which is produced by the valve folded in exhaustion.

The above phenomena not only degrade the entire efficiency of the reciprocating compressor but also provide users with displeasure due to heavy noise.

SUMMARY OF THE INVENTION

The present invention has been made in conjunction with the above problems and it is therefore an object of the invention to provide an exhaust valve capable of elevating compression efficiency by correctly opening an exhaust port.

It is another object of the invention to provide a reciprocating compressor having the above exhaust valve.

According to an aspect of the invention to obtain the above objects, it is provided an exhaust apparatus comprising: a guide connected in parallel to an exhaust port of a cylinder; a needle valve provided inside the guide for opening/shutting the exhaust port while moving in cooperation with the guide; and an electromagnet provided in the rear of the guide for controlling the needle valve.

In the exhaust apparatus, the needle valve is preferably a permanent magnet.

Preferably, the exhaust apparatus further comprises metallic materials having magnetism at both sides of the exhaust port for opening the exhaust port of the cylinder for a predetermined range, in which the predetermined range means a range where the electromagnet has a flux density larger than a critical flux density, and the critical flux density is determined from the attraction between the metallic materials and the needle valve.

In the exhaust apparatus, the guide is connected in perpendicular to the exhaust port of the cylinder, and the electromagnet is provided in the rear of the guide when the guide is provided perpendicular to the exhaust port of the cylinder.

According to another aspect of the invention to obtain the above objects, it is provided a reciprocating compressor comprising: a cylinder having a predetermined internal space; a piston for linearly reciprocating inside the cylinder; and exhaust means for exhausting fluid which is compressed due to linear reciprocation of the piston according to opening/shutting means moving corresponding to the flux density of an electromagnet.

In the reciprocating compressor, the exhaust means may comprise: a guide connected in parallel or perpendicular to an exhaust port of the cylinder; and the electromagnet provided in the rear of the guide for controlling the opening/shutting means.

In the reciprocating compressor, the opening/shutting means is preferably a permanent magnet.

Preferably, the reciprocating compressor may further comprise an exhaust tube on one side of the guide for exhausting fluid and metallic materials having magnetism at both sides of the exhaust port of the cylinder for maintaining the attraction with the opening/shutting means when the guide is parallel to the exhaust port of the cylinder.

Preferably, the reciprocating compressor may further comprise an exhaust tube parallel to the exhaust port of the cylinder and a metallic material having magnetism at one end of the guide for maintaining the attraction with the opening/shutting means when the guide is perpendicular to the exhaust port of the cylinder.

In the reciprocating compressor, the intensity of the flux density of the electromagnet is varied proportionally to the displacement of the piston, and the flux density of the electromagnet takes place according to a current applied to the electromagnet.

According to still another aspect of the invention to obtain the above objects, it is provided an exhaust apparatus comprising: a guide penetrating in parallel an exhaust port connected in parallel to an exhaust port of a cylinder; a needle valve provided inside the guide for opening/shutting the exhaust port while moving in cooperation with the guide; and an electromagnet provided in the rear of the guide for controlling the needle valve.

DETAILED DESCRIPTION OF THE PREFERRED EMBODIMENT

The following detailed description will present preferred embodiments of the invention in reference to the accompanying drawings.

Figure 1:
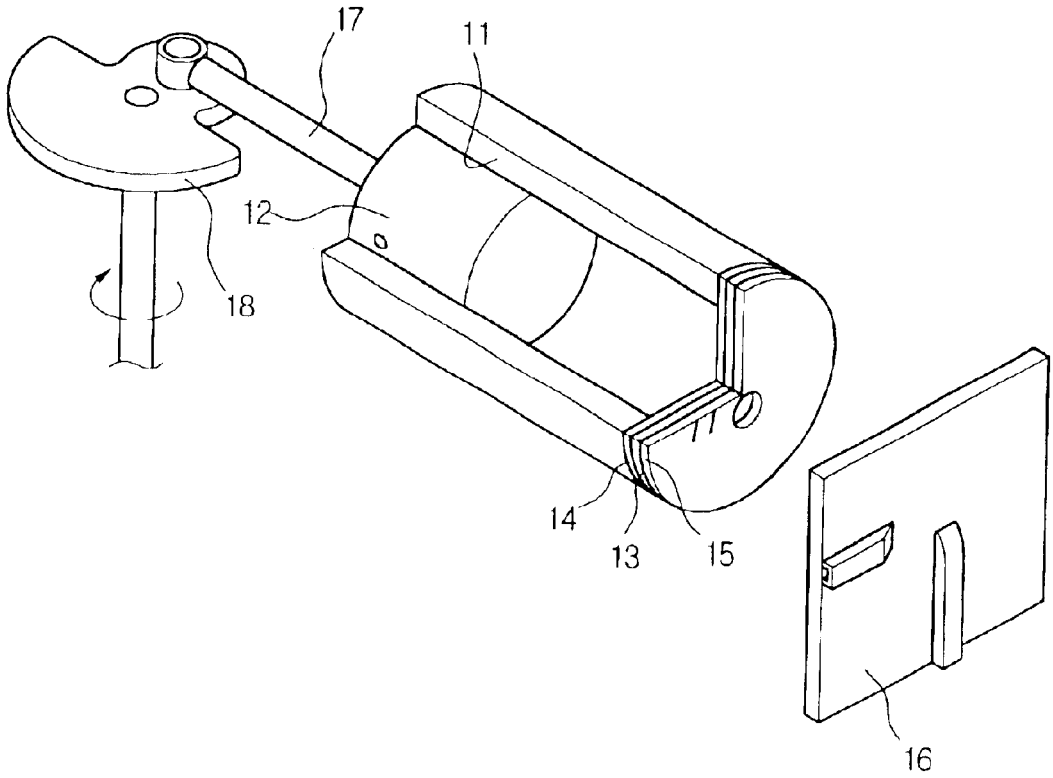
Fig. 1(Related Art)
FIG. 1 is a schematic perspective view illustrating a conventional reciprocating compressor.
Figure 2A:
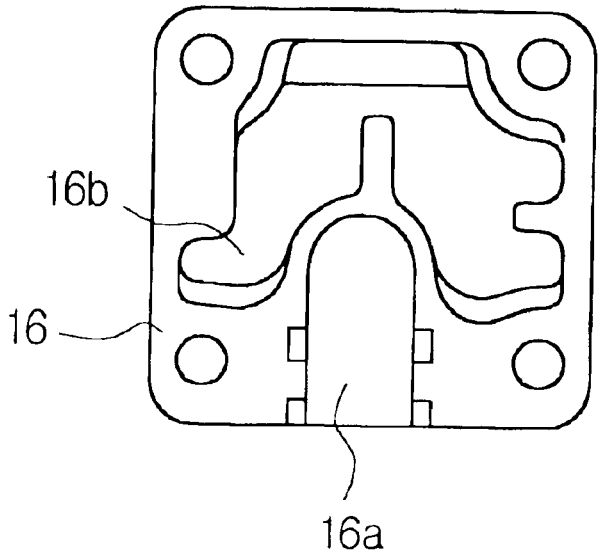
Fig. 2A(Related Art)
FIGS. 2A to 2D are schematic plan views illustrating a head cover, an exhaust valve, a valve plate and a suction valve, respectively, in a conventional reciprocating compressor.
Figure 2B:
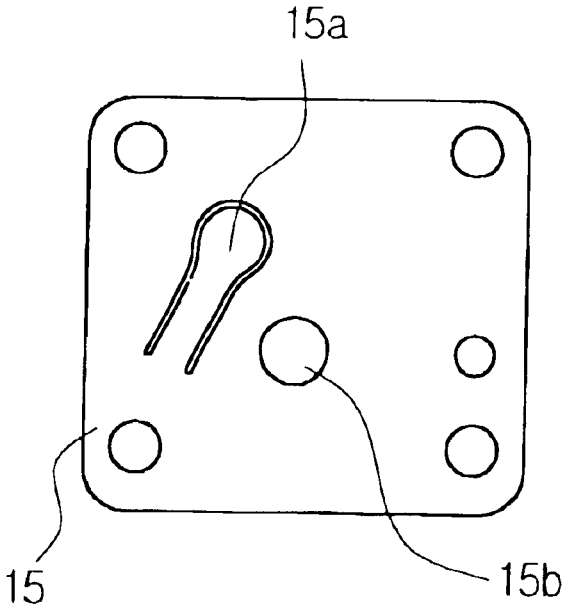
Fig. 2B(Related Art)
Figure 2C:
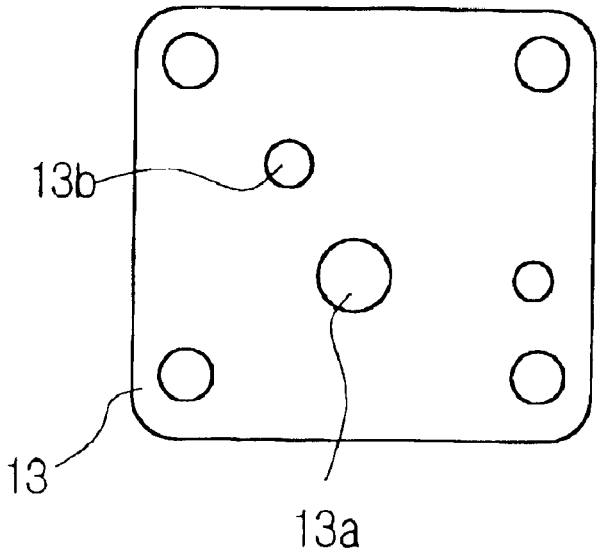
Fig. 2C(Related Art)
Figure 2D:
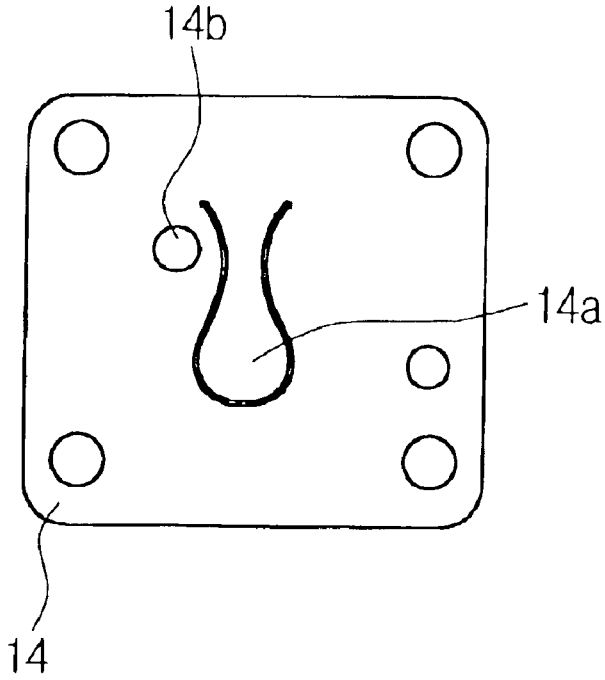
Fig. 2D(Related Art)
Figure 3A:
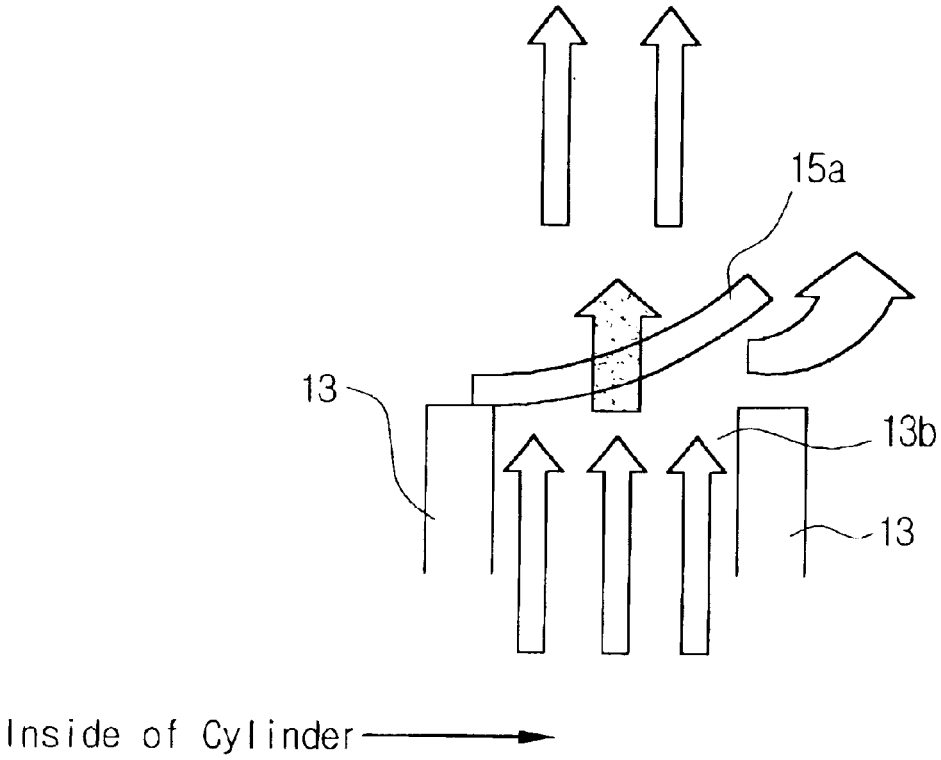
Fig. 3A(Related Art)
FIGS. 3A and 3B schematically illustrate the operation of an exhaust valve in a conventional reciprocating compressor.
Figure 3B:
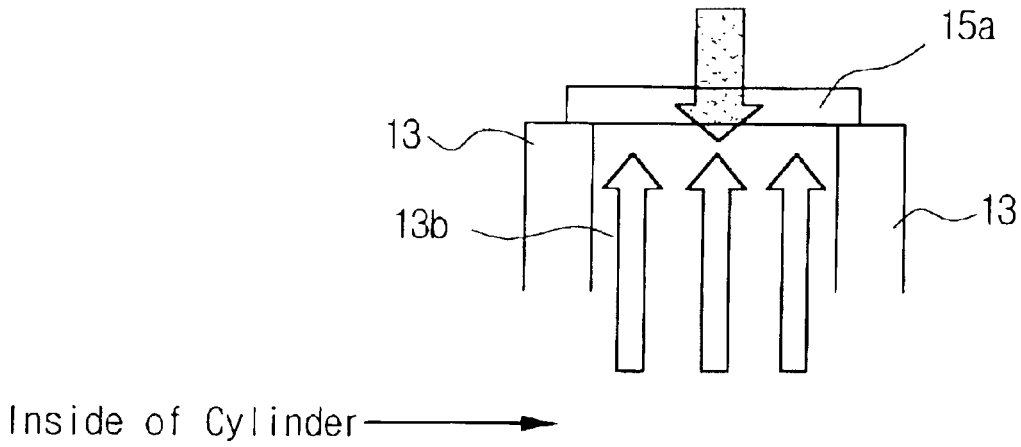
Fig. 3B(Related Art)
Figure 4A:
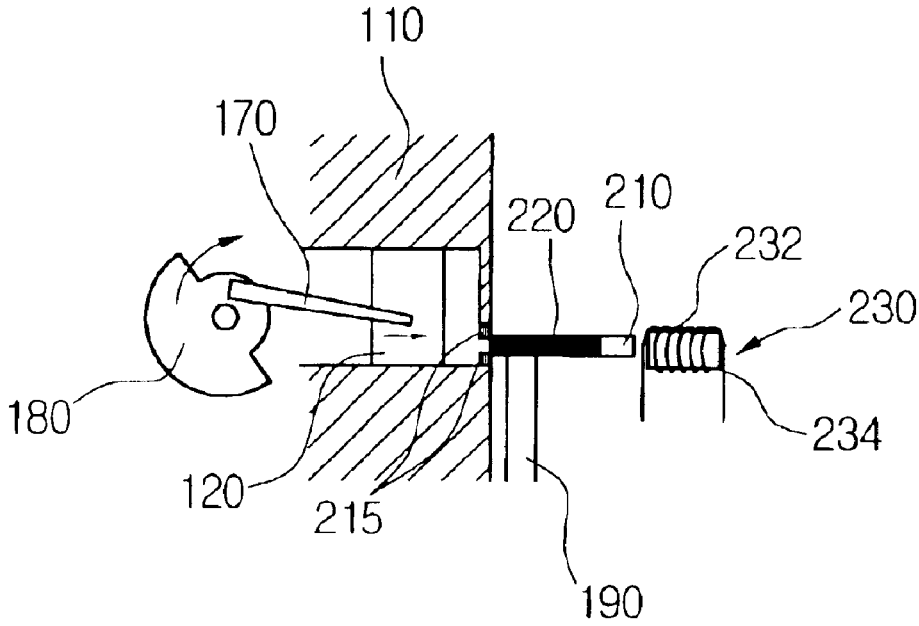
FIGS. 4A to 4C illustrate a reciprocating compressor according to the first embodiment of the invention.
Figure 4B:
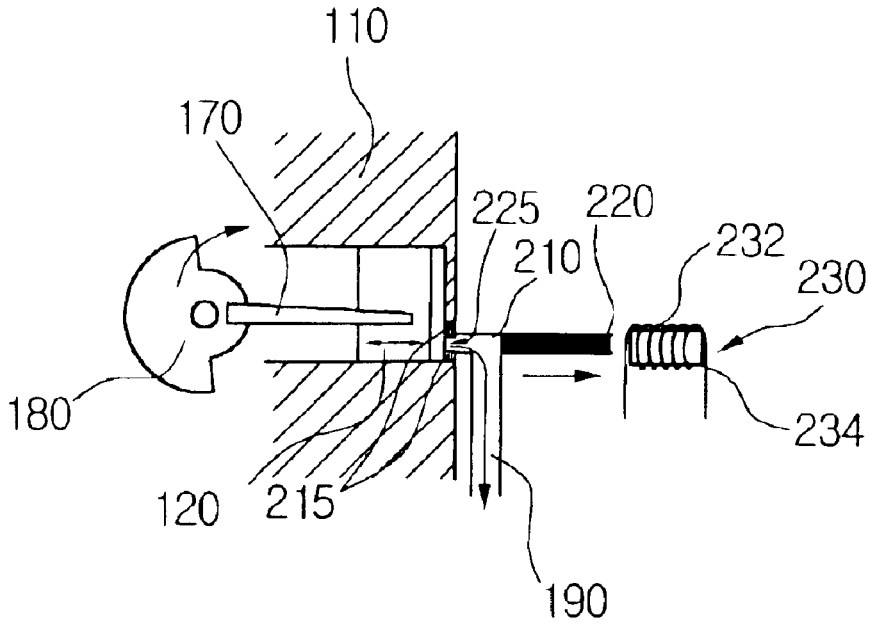
Figure 4C:
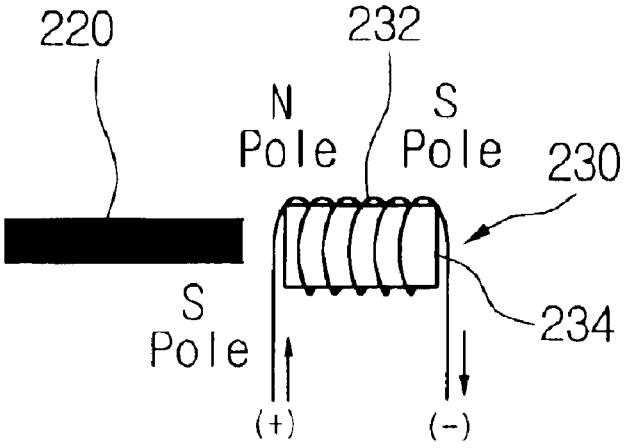
Figure 5:
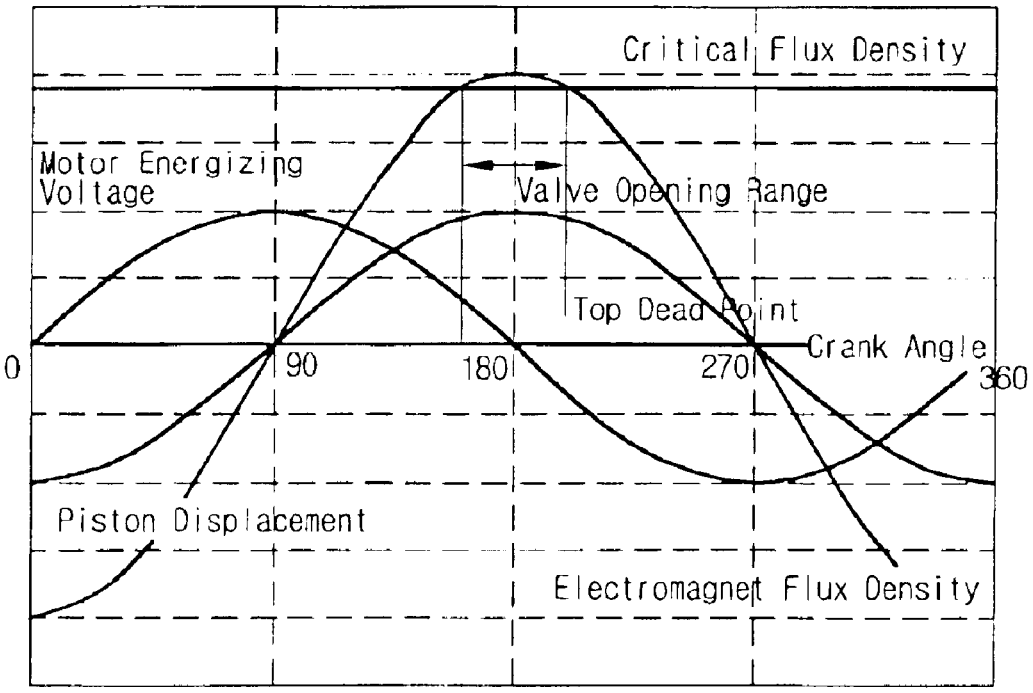
FIG. 5 illustrates an opening range of an exhaust port of a cylinder according to the flux density of an electromagnet in a reciprocating compressor according to the first embodiment of the invention.

FIGS. 4A to 4C illustrate a reciprocating compressor according to the first embodiment of the invention, in which FIG. 4A shows a position where an exhaust port is shut, FIG. 4B shows a position where the exhaust port is open, and FIG. 4C shows the relation between a permanent magnet and an electromagnet.

Referring to FIGS. 4A and 4B, the reciprocating compressor has a cylinder 110 with a space therein, a piston 120 performing a linear reciprocating motion inside the cylinder 110 and an exhaust valve for exhausting fluid according to the linear reciprocating motion of the piston 120. The exhaust valve connected in the direction of the linear reciprocating motion of the piston 120 has a guide 210 connected to an exhaust port 225 of the cylinder 110, a needle valve 220 moving in cooperation with the guide 210 for opening/shutting the exhaust port 225 and an electromagnet 230 for controlling movement of the needle valve 220. Preferably, the needle valve 220 is a permanent magnet.

Describing the above in more detail, the cylinder 110 is a member having a column-shaped internal space in general with a suction port (not shown) and the exhaust port 225 provided at the closed end of the internal space for suction/exhaustion of fluid.

The piston 120 is a member for linearly reciprocating in the internal space of the cylinder to compress fluid introduced into the cylinder 110. Therefore, it is preferred that the piston 120 is cylindrically shaped so as to conform to the internal space of the cylinder 110.

Further, the piston 120 is provided at one end with a connecting rod 170 for linearly reciprocating the piston 120 and a crank shaft 180 connected to the connecting rod 170.

The exhaust valve has the needle valve 220 and the electromagnet 230 for moving the needle valve 220 as set forth above. The needle valve 220 may be made of a permanent magnet. The electromagnet 230 has an iron core 234 having a certain length and a coil 232 wound around the iron core 234 with a certain interval. Further, the exhaust valve is provided with the guide 210 which is so connected to the exhaust port 225 that the needle valve 220 may move.

The guide 210 defines a non-magnetic linear space having a certain length connected to the exhaust port 225 and parallel to the cylinder 110, in which the length is preferably longer than the length of the needle valve 220. To a specific side region of the guide 210, in particular, to a specific region of the internal space of the guide 210 which is defined when the needle valve 220 moves backward, is connected an exhaust tube 190.

The needle valve 220 is a member for opening/shutting the exhaust port 225 while moving in cooperation with the guide 210, and preferably made of a permanent magnet having a certain degree of magnetism. The needle valve 220 has a diameter which is so large to cover the exhaust port 225 and a length which is determined considering the relation with the exhaust tube 190. In other words, the needle valve 220 has such a length that the exhaust valve 225 may be opened when the needle valve 220 moves backwards in cooperation with the guide 210.

The electromagnet 230 is a member for having magnetism due to application of electricity, and positioned in the rear of the guide 210 (i.e. in the right of the guide 210 in the drawings) for reciprocating the needle valve 220 in the guide 210. Positive (+) and negative (−) currents are alternatingly applied to the electromagnet 230 to change the polarity of the electromagnet.

In this embodiment, the needle valve 220 has fixed poles such as S pole on the side of the electromagnet and N pole on the opposite side (i.e. on the side of the cylinder). Therefore, when the positive (+) current is applied to the left coil wound around the electromagnet 230, a front portion of the electromagnet has N polarity. On the contrary, when the negative (−) current is applied to the left coil, the front portion of the electromagnet has S polarity.

Therefore, if the front portion of the electromagnet has N polarity, the needle valve 220 is attracted toward the electromagnet 230. If the front portion of the electromagnet has S polarity, the needle valve moves farther apart from the electromagnet.

The operation of the reciprocating compressor according to the first embodiment of the invention will be described as follows: When AC power drives a motor, the crank shaft 180 accordingly performs a circular motion. The piston 120 moves forward in cooperation with the connecting rod 170 connected to the crank shaft 180 to compress fluid existing inside the cylinder 110. When the piston 120 moves forward, positive (+) current is applied to the left coil of the electromagnet 230 to increase the flux density of the electromagnet. In this case, the flux density of the electromagnet increases in proportion of the degree of forward movement of the piston 120.

When the piston 120 moves for a certain degree, the flux density of the electromagnet exceeds the critical flux density, where the flux density of the electromagnet moves the needle valve 220 toward the electromagnet so as to open the exhaust port of the cylinder 110. In order that the needle valve 220 may not move toward the electromagnet until the flux density of the electromagnet reaches the critical flux density, the exhaust port 225 of the cylinder 110 is preferably provided at both sides with metallic materials 215 having magnetism. Therefore, magnetic attraction acts between the metallic materials 215 and the needle valve 220 so that the needle valve may not move toward the electromagnet until the flux density of the electromagnet exceeds the critical flux density.

In this case, the critical flux density is proportional to the attraction between the needle valve and the metallic materials. Therefore, the attraction between the needle valve and the metallic materials are adjusted so that a valve opening range where the flux density of the electromagnet is larger than the critical flux density may continue for a certain area.

As the exhaust port 225 of the cylinder 110 is opened, fluid compressed in the cylinder 110 is exhausted to the outside via the exhaust tube 190 formed in the side of the guide 210.

In the meantime, as the crank shaft 180 performs the circular motion beyond the top dead point, the piston 120 accordingly moves backward. Further, as the positive (+) current applied to the electromagnet decreases, the flux density of the electromagnet also decreases. At the moment that the flux density of the electromagnet decreases to or under the critical flux density, the needle valve 220 moved toward the electromagnet moves backward to the cylinder 110 due to attraction to the metallic materials installed in the opposite direction so as to shut the exhaust port 225.

Figure 6A:
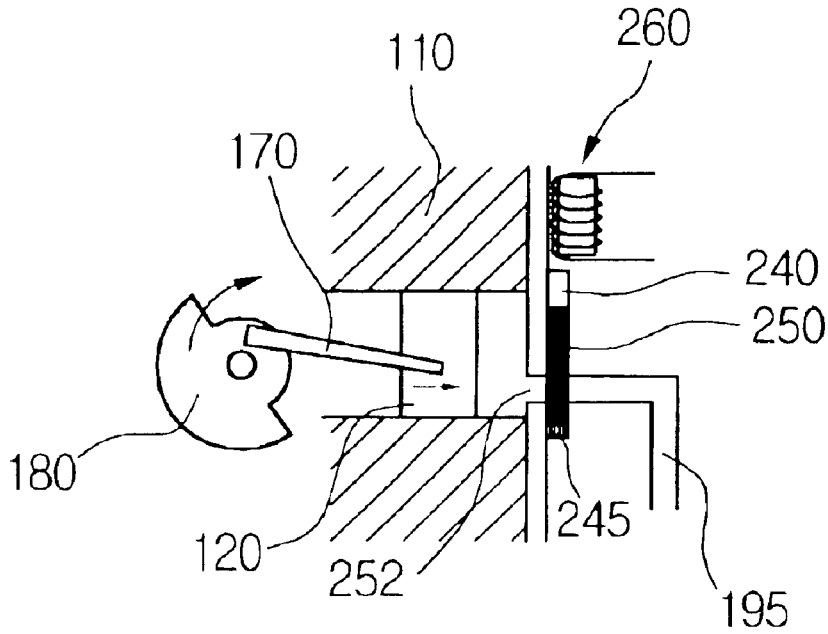
FIGS. 6A and 6B illustrate a reciprocating compressor according to the second embodiment of the invention.
Figure 6B:
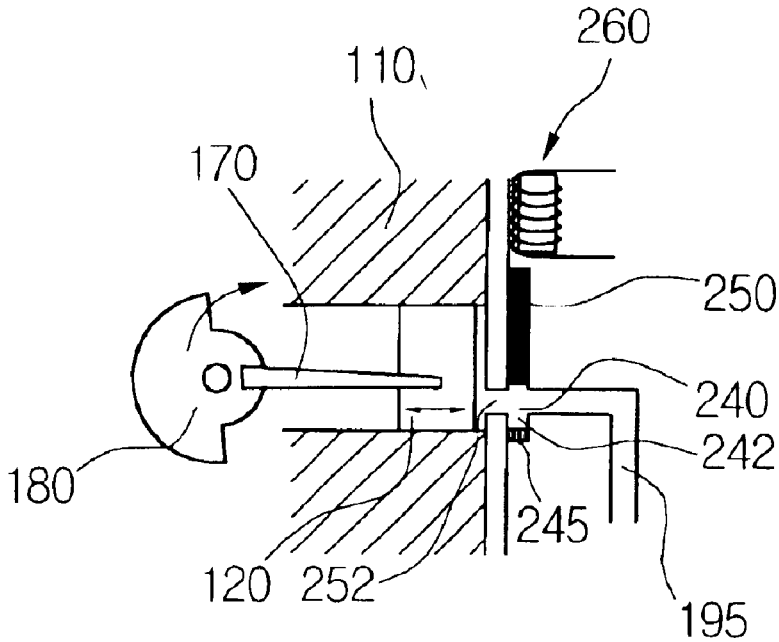

FIGS. 6A and 6B illustrate a reciprocating compressor according to the second embodiment of the invention, in which FIG. 6A shows a position where an exhaust port is shut, and FIG. 6B shows a position where the exhaust port is opened. In the second embodiment of the invention, description of those portions same or similar to the first embodiment shown in FIG. 4 will be omitted in order to avoid repetition.

Referring to FIGS. 6A and 6B, it can be seen that a guide 240 is installed with an angle different from that of the guide shown in FIGS. 4A and 4B. In other words, the guide 210 is installed parallel to the cylinder 110 in FIGS. 4A and 4B, whereas the guide 240 is installed perpendicular to the cylinder 110 in FIGS. 6A and 6B. Preferably, an exhaust tube 190 is installed parallel to the cylinder 110. The guide 240 is installed perpendicular to the exhaust tube 190 at a certain distance from the exhaust tube 190 connected in parallel to the exhaust port 252 of the cylinder, and has a project 242 in the opposite of an electromagnet 260 for assisting the exhaust tube 190 to be completely shut. The guide project 242 is preferably attached with a metallic material 245 having magnetism for inducing attraction between the guide project 242 and the needle valve 250.

Further, in the opposite of the guide project 242, is provided an electromagnet 260 and a needle valve 250 which is moved into the guide 240 by the electromagnet 260.

According to the above configuration, the pressure due to fluid existing inside the cylinder and applied to the needle valve in FIGS. 4A and 4B does not interfere movement of the needle valve as the needle valve 250 is installed perpendicular to the cylinder 110.

As set forth above, the exhaust valve of the invention has the needle valve together with the guide and the electromagnet for assisting the needle valve to open/shut the exhaust port of the cylinder so that the exhaust port of the cylinder can be completely opened in exhaustion, thereby reducing degradation of compression efficiency due to valve damage and generation of vibration noise.

Further, the movement of the piston and the flux density of the electromagnet are adjusted so that the exhaust port of the cylinder can be opened thereby complementing damage due to overshooting.

The exhaust valve described in the invention is simple with configuration and operation so as to be applied to all devices requiring suction and exhaust procedures thereby maximizing the range of application thereof.

What is claimed is:

1. An exhaust apparatus comprising:

a guide connected in parallel to an exhaust port of a cylinder;

a valve body provided inside said guide that opens/shuts said exhaust port while moving in cooperation with said guide; and an electromagnet provided in the rear of said guide that controls said valve body, wherein said valve body is permanent magnet.

2. The exhaust apparatus according to claim 1, wherein said valve body has a diameter larger than that of said exhaust port.

3. The exhaust apparatus according to claim 1, further comprising metallic materials having magnetism at both sides of said exhaust port that opens said exhaust port of said cylinder for a predetermined range.

4. The exhaust apparatus according to claim 3, wherein the electromagnet has a flux density larger than a critical flux density in the predetermined range.

5. The exhaust apparatus according to claim 4, wherein the critical flux density is determined from the attraction between said metallic materials and said valve body.

6. An exhaust apparatus comprising:

a guide connected in perpendicular to an exhaust port of a cylinder;

a valve body provided inside said guide that opens/shuts said exhaust port while moving in cooperation with said guide; and an electromagnet provided in the rear of said guide that controls said valve body, wherein said valve body is a permanent magnet.

7. The exhaust apparatus according to claim 6, wherein said electromagnet is provided in the rear of said guide.

8. A reciprocating compressor comprising:

a cylinder having a predetermined internal space;

a piston that linearly reciprocates inside said cylinder; and an exhaust device that exhausts fluid which is compressed due to linear reciprocation of said piston according to opening/shutting device moving corresponding to the flux density of an electromagnet, wherein said exhaust device comprises:

a guide connected in parallel or perpendicular to an exhaust port of said cylinder; and said electromagnet provided in the rear of said guide that controls said opening/shutting device.

9. The reciprocating compressor according to claim 8, wherein said opening/shutting device is a permanent magnet.

10. The reciprocating compressor according to claim 8, further comprising an exhaust tube on one side of said guide that exhaust fluid when said guide is parallel to said exhaust port of said cylinder.

11. The reciprocating compressor according to claim 8, further comprising metallic materials having magnetism at both sides of said exhaust port of said cylinder for maintaining the attraction with said opening/shutting device when said guide is parallel to said exhaust port of said cylinder.

12. The reciprocating compressor according to claim 8, further comprising an exhaust tube parallel to said exhaust port of said cylinder when said guide is perpendicular to said exhaust port of said cylinder.

13. The reciprocating compressor according to claim 8, further comprising a metallic material having magnetism at one end of said guide that maintains the attraction with said opening/shutting device when said guide is perpendicular to said exhaust port of said cylinder.

14. The reciprocating compressor according to claim 8, wherein the flux density of said electromagnet is varied proportionally to the displacement of said piston.

15. The reciprocating compressor according to claim 8, wherein the flux density of said electromagnet takes place according to a current applied to said electromagnet.

16. The reciprocating compressor according to claim 8, wherein said exhaust port of said cylinder is opened while the flux density of said electromagnet exceeds a critical flux density.

17. The reciprocating compressor according to claim 16, wherein the critical flux density is determined from the attraction between said metallic material and said opening/shutting device.

18. An exhaust apparatus comprising:

a guide penetrating in parallel an exhaust port connected in parallel to an exhaust port of a cylinder;

a valve body provided inside said guide that opens/shuts said exhaust port while moving in cooperation with said guide; and an electromagnet provided in the rear of said guide that controls said valve body, wherein said valve body is a permanent magnet.

19. The exhaust apparatus according to claim 18, further comprising a metallic material having megnetism in the front of said guide that maintains the attraction with said valve body.

20. The exhaust apparatus according to claim 19, wherein a critical flux density is determined from the attraction between said metallic material and said valve body.

21. The exhaust apparatus according to claim 18, wherein said exhaust port of said cylinder is opened while a flux density generated from said electromagnet exceeds a critical flux density.

* * * * *

UNITED STATES PATENT AND TRADEMARK OFFICE

CERTIFICATE OF CORRECTION

PATENT NO. : 6,790,018 B2
DATED : September 14, 2004
INVENTOR(S) : I. Lee et al.

It is certified that error appears in the above-identified patent and that said Letters Patent is hereby corrected as shown below:

Column 7,
Line 24, after “is” insert -- a --.

Column 8,
Line 8, “exhaust” should read -- exhausts --.

Signed and Sealed this

Seventeenth Day of May, 2005

JON W. DUDAS
*Director of the United States Patent and Trademark Office*